US005831189A

United States Patent [19]

Edlund

[11] Patent Number: 5,831,189

[45] Date of Patent: Nov. 3, 1998

[54] DEVICE FOR FACILITATING THE PLAYING OF STRINGED INSTRUMENTS

[76] Inventor: Arne Edlund, Tvärgränd 5, Sundsvall, Sweden, S-852 38

[21] Appl. No.: 793,363

[22] PCT Filed: Aug. 24, 1995

[86] PCT No.: PCT/SE95/00956

§ 371 Date: Feb. 24, 1997

§ 102(e) Date: Feb. 24, 1997

[87] PCT Pub. No.: WO96/06424

PCT Pub. Date: Feb. 29, 1996

[30] Foreign Application Priority Data

Aug. 25, 1994 [SE] Sweden ..... 9402841
Jan. 12, 1995 [SE] Sweden ..... 9500093

[51] Int. Cl.[6] ..... G10D 3/00

[52] U.S. Cl. ..... 84/315; 84/317

[58] Field of Search ..... 84/315, 316, 317, 84/318, 319

[56] References Cited

U.S. PATENT DOCUMENTS

| | | | |
|---|---|---|---|
| 1,094,038 | 4/1914 | Weaver et al. | 84/317 |
| 3,422,717 | 1/1969 | Roussel | 84/317 |
| 3,568,560 | 3/1971 | Chang et al. | 84/371 |
| 3,568,650 | 3/1971 | Chang et al. | 123/559.1 |
| 3,776,088 | 12/1973 | Jones | 84/317 |
| 4,228,718 | 10/1980 | Smith | 84/317 |
| 4,428,273 | 1/1984 | Favron | 84/317 |

*Primary Examiner*—Michael L. Gellner
*Assistant Examiner*—Shih-yung Hsieh
*Attorney, Agent, or Firm*—Young & Thompson

[57] ABSTRACT

A device for facilitating the playing of stringed instruments comprises a stand (6) with two lateral pieces (7, 7') between which is arranged a pressure plate (5) with a length which is larger than the distance between at least three crossbars (3) on a neck of the instrument, and a width that is larger than the distance between maximally separated strings (2). On its underside, the pressure plate has protruding abutment elements (12), the plate being on one hand reciprocally displaceable relative to the stand, and on the other hand being capable of being pressed down against the force of springs (10) in the direction of the neck (1) in order to activate a combination of transmission device (5) included in the stand by a desired, corresponding combination of abutment elements, the transmission device having the purpose of stretching strings against the crossbars (3), so that the strings deliver a desired chord.

20 Claims, 2 Drawing Sheets

DEVICE FOR FACILITATING THE PLAYING OF STRINGED INSTRUMENTS

TECHNICAL FIELD OF THE INVENTION

This invention relates to a device for facilitating the playing of stringed instruments, e.g. guitars, of the type comprising a plurality of strings located along a neck on which there are interspaced crossbars for determining the tone-decisive length of individual strings.

BACKGROUND OF THE INVENTION

To learn to play the guitar or other stringed instruments is associated with difficulties not only for beginners but also for people having a handicap, for instance in the fingers of the hand. Further, many people do not have the ambition of wanting to master the playing technique in a perfect or masterly manner, but are content with being able to perform a few simple chords. However, also in the latter case elementary fingerings have to be practised and this is often time-consuming and tedious, in particular for people with stiff and/or handicapped fingers.

OBJECTS AND FEATURES OF THE INVENTION

The present invention aims at providing a device by means of which also the entirely unlearned shall be able to play stringed instruments of the type initially referred to, without any manifest practice. The device shall even enable people who wholly or partly lack fingers to play on, e.g., a guitar.

The object of the invention is attained by a device of the type as defined in the characterizing clause of claim 1. Advantageous embodiments of the invention are further defined in the dependent claims.

BRIEF DESCRIPTION OF THE APPENDED DRAWINGS

In the drawings:

FIG. 1 is a partly cut, simplified perspective view showing a device according to the invention applied upon the neck of a guitar, FIG. 2 is an enlarged partial cross-section through a pressure plate comprised by the device, FIG. 3 is a perspective view illustrating a second, alternative embodiment of the device, and FIG. 4 is a perspective view showing a third, alternative embodiment.

DETAILED DESCRIPTION OF PREFERRED EMBODIMENTS OF THE INVENTION

Figure 1:
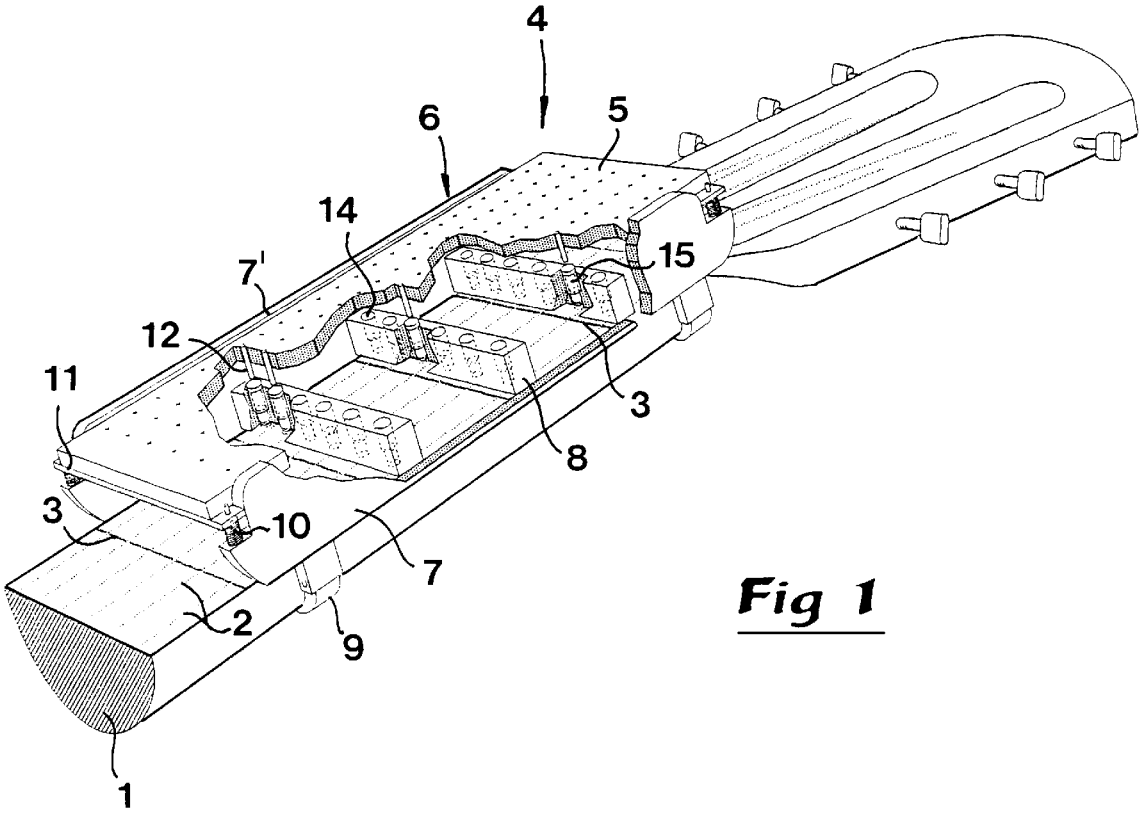

In FIG. 1 reference numeral 1 designates a guitar neck on the top side of which there are on one hand a number of strings 2 (more specifically, six), and on the other hand a number of axially interspaced crossbars 3 of conventional type. A device according to the invention, which device in this case is constructed as a detachable attachment unit, is designated 4 in its entirety. This device comprises on one hand a pressure plate 5, and on the other hand a stand designated 6 in its entirety, which comprises two lateral pieces 7, 7 ' between which extend a number of cross-pieces 8 which form a shape-stiff unit with the lateral pieces. To the stand also belong one or several holding devices 9, by means of which the stand can be mounted on the guitar's neck. The pressure plate 5 has a length that is larger than the distance between at least three crossbars 3 and a width that is larger than the distance between maximally separated outer strings. The internal distances between the three cross-pieces 8 shown in the example substantially correspond to the internal distances between adjacent crossbars 3.

Figure 2:
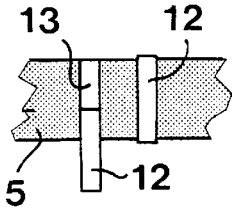
Figure 4:
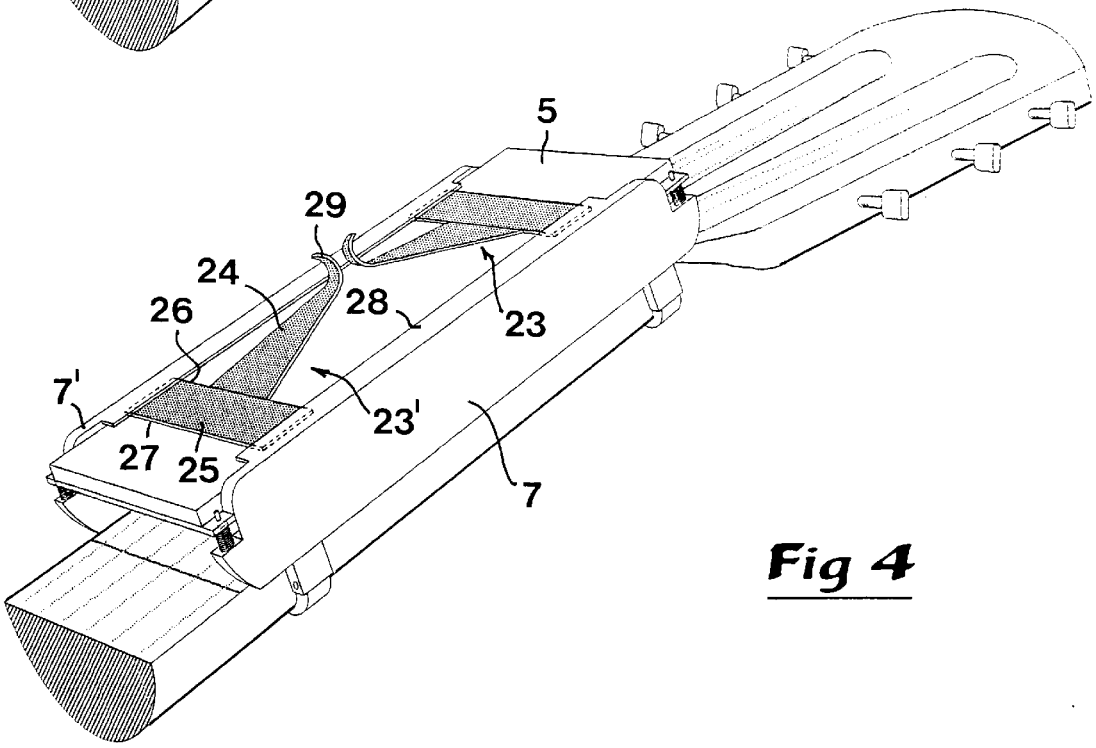

The pressure plate 5 is axially displaceable in relation to the stand 6 and is also possible to press down against the force of springs 10, more specifically from an upper initial position in a direction downwardly towards the guitar neck. According to the embodiment schematically shown in FIG. 1, the plate 5 rests upon rims 11 carried by the springs 10, the plate being displaceable axially relative to the rims. A number of abutment elements 12 protrude from the underside of pressure plate 5, which elements according to the example have the shape of pins. According to the exemplified embodiment, the pressure plate comprises equally many (i.e., six) rows of pins as the number of strings, each row in practice being capable of comprising ten to thirty pins. As may be seen in the detail cross-section in FIG. 2, each individual pin 12 is adjustably movable between on one hand an inactive position introduced into a hole 13 and on the other hand an active position protruding downwardly from the hole. In FIG. 4 four pins 12 are shown, adjusted to an active, downwardly protruding position, more specifically for the formation of the chord C.

In the cross-pieces 8 there are cylindrical recesses 14, each one of which containing a spring-loaded transmission means with the shape of a tap 15 that is normally held in an upper initial position by an appurtenant spring. When an abutment pin activates the tap 15 by the fact that the pressure plate 5 is pressed down against the force of the springs 10, the activated tap will be pushed down towards and squeeze an appurtenant guitar string 2. In this way, the individual guitar string is stretched along a given length in order to deliver a definite tone when playing.

The four activated abutment pins 12 correspond to and replace the fingering of the hand at normal guitar playing. By combining in a suitable way different abutment pins out of the plurality of pins that are available on the pressure plate 5, a well-nigh unlimited number of chords can be obtained. By the fact that the pressure plate 5 is axially displaceable, the activating pins can be moved between different positions in which different chords are produced.

Figure 3:
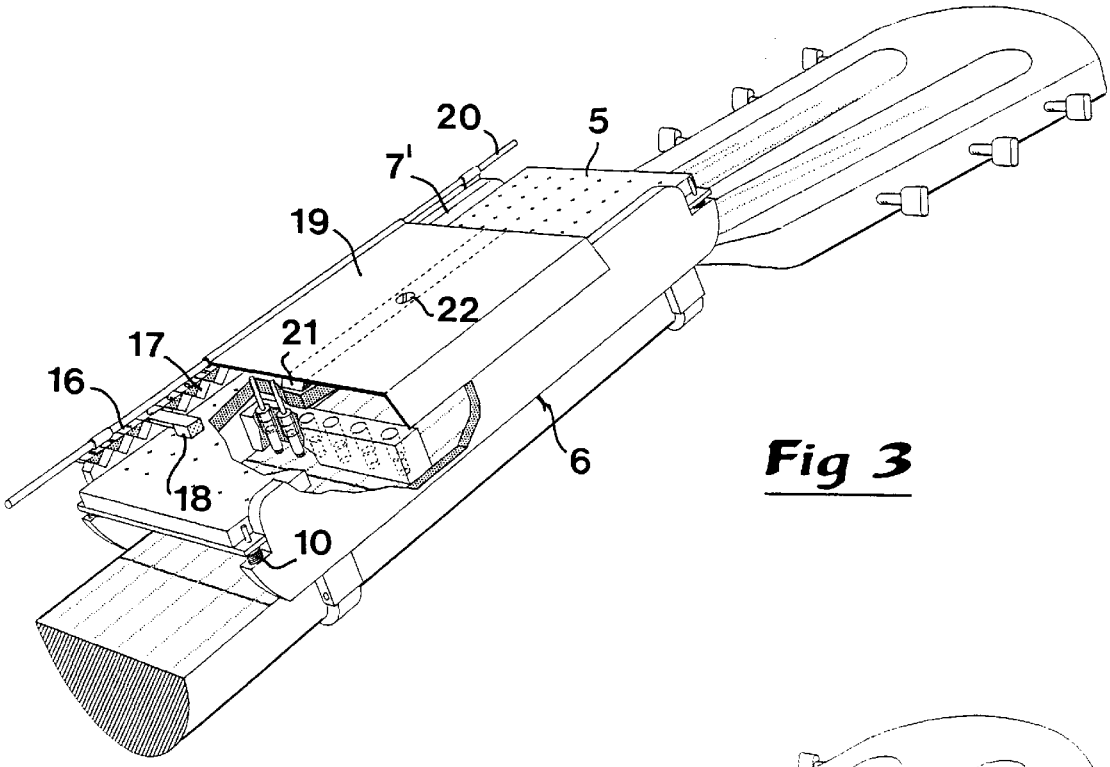

In FIG. 3 an alternative, further developped embodiment is shown, according to which the stand 6 comprises a position scale 16 which gives a number of common chords. More specifically, the scale 16 is arranged in the region of the upper edge of one lateral piece 7' of the stand. The scale cooperates with a corresponding number of recesses 17, each one of which being capable of receiving a stop element 18 fixedly connected to the pressure plate 5, said element having the shape of a protruding bar. The stop bar 18 can be brought into engagement within the individual recess 17 when the plate S is pressed down against the force of the springs 10, as shown in FIG. 3. In order to simplify a quick and exact determination of the axial position of the pressure plate, both the recesses 17 and the stop bar 18 are V-shaped cross-sectionally. This implies that the stop bar is automatically centered when it is pressed down into a selected recess. Thus, when playing, the pressure plate can be moved so that the stop bar 18 is situated in the region of a chord indicated on the scale 16, the pressure plate taking an exact adjusted position for the given chord when the stop bar has been led down into the recess in question.

Moreover, according to the embodiment of FIG. 3, the pressure plate 5 is arranged to cooperate with a special key plate 19 which is pivotally connected to and axially movable along an axis or bar 20 fastened on the stand. On the top side of the pressure plate 5 is arranged a central ridge 21 with which the key plate 19 is connected via a carrier 22 which on one hand carries the pressure plate 5 when the key plate 19 is moved axially, and on the other hand allows a certain possibility of motion between the two plates in connection with the pressing down. An essential advantage of the key plate 19 is that it simplifies the activation of the pressure plate for people with short or weakened fingers. Hence, the fingers of the hand may be applied in the region of the free end of the key plate, said key plate, by acting as a lever, being capable of exerting a comparatively large force upon the pressure plate, via the ridge 21.

In FIG. 4 an alternative embodiment is shown, according to which the pressure plate 5 cooperates with two lever means 23, 23', each of which comprising on one hand an arm 24, and on the other hand a cross-plate 25 which has inner and outer edges 26 and 27, respectively. The arm 24 is obliquely placed with a certain angle relative to the cross-plate 25, more specifically in such a way that the arm 24 in an initial position points obliquely inwards/upwards at the same time as the plate 25 supports against the pressure plate 5. It should also be observed that the opposed end portions of the cross-plate 25 are introduced under longitudinal edge flanges 28 on the lateral pieces 7, 7' of the stand. When the individual arm 24 is pressed down in the direction of the plate 5, then the plate 25 turns around its inner edge 26, whereby the plate forces the pressure plate to move downwardly from the edge flanges 28, in that the rear edge 27 supports against the underside of the flanges 28. Thus, when the arms 24 of the two means 23, 23' are simultaneously turned in a downward direction by the fingers of the hand, the pressure plate will be pressed down at four separate points. In other words, it is safeguarded that the pressure plate moves parallel with the top side of the guitar neck, so that all activated abutment pins achieve a substantially simultaneous stretching of the guitar strings in question. Also according to the embodiment of FIG. 4, the plate 5 may be pressed down by a large force by means of the force-amplifying lever means 23, 23'.

It should be noted that the arms 24 have bent or curved portions 29 at their free ends. These curved end portions facilitate the axial movement of pressure plate 5. In this context it should be underlined that the two lever means 23, 23' are connected with the pressure plate in a suitable way so that it is carried with them when the arms are moved manually.

FEASIBLE MODIFICATIONS OF THE INVENTION

The invention is not limited solely to the embodiments as described and shown in the drawings. Thus, it is for instance feasible to provide a restricted number of fixed abutment elements in the form of pins or protrusions on the underside of the pressure plate, which are so placed in a given combination that they bring about a number of given chords. In such cases, the pressure plate is advantageously detachably mounted in the stand so that it may be replaced by another pressure plate with fixed abutment elements which bring about other chords. It is further possible to use other transmission means than the spring-loaded taps 15 as shown and described. Thus, the transmission means which are activatable by the abutment elements, may consist of cushions or other soft means applied upon the free ends of ribbed springs whose opposed ends are fastened on the underside of a cross-piece comprised by the stand. It may also be mentioned that the device may be permanently integrated with the stringed instrument in question instead of being produced as a detachable attachment unit of the type exemplified in the drawings.

I claim:

1. A device for facilitating the playing of stringed instruments, comprising a plurality of strings (2) located along a neck (1) on which there are interspaced crossbars for determining the tone-decisive length of individual strings, characterized in that it comprises a stand (6) with two lateral pieces (7, 7') between which is arranged a pressure plate (5) which has a length that is larger than the distance between at least three crossbars (3) and a width that is larger than the distance between maximally separated strings, and which on its underside has protruding and projecting abutment elements (12), the plate (5) having means for reciprocally displacing the plate relative to the stand, and pressing down against the force of one or several springs (10) in the direction of said neck (1) in order to activate a combination of transmission means (15) included in the stand by a desired corresponding combination of abutment elements, said transmission means stretching strings against said crossbars (3) so that the strings deliver the desired chord.

2. Device according to claim 1, characterized in that the transmission means are in the shape of taps (15) which are arranged in recesses (14) in cross-pieces (8) extending between the lateral pieces (7, 7') of the stand, the individual tap (15) pressing downwards against the appurtenant string (2) against the force of a spring, when being activated by an abutment element (12) on the pressure plate.

3. Device according to claim 2, characterized in that the pressure plate (5) is arranged to cooperate with a key plate (19) which is pivotally connected with and axially displaced along an axis (20) arranged on the stand (6), and connected with a ridge (21) centrally arranged on the top side of the pressure plate (5), via a carrier (22) carrying the pressure plate along when the key plate (19) is moved.

4. Device according to claim 2, characterized in that a position scale (16) is connected with the stand, which scale gives a number of common chords and with which scale cooperates a number of recesses (17) corresponding to the chords, and in that a stop element (18) is connected with the pressure plate (5), said element being brought into engagement with a selected recess (17) in order to withhold the plate in an axial adjusted position that corresponds to a desired chord.

5. Device according to claim 4, characterized in that the pressure plate (5) is arranged to cooperate with a key plate (19) which is pivotally connected with and axially displaced along an axis (20) arranged on the stand (6), and connected with a ridge (21) centrally arranged on the top side of the pressure plate (5), via a carrier (22) carrying the pressure plate along when the key plate (19) is moved.

6. Device according to claim 4, characterized in that the individual recess (17) is cross-sectionally V-shaped and that the stop element (18) is cross-sectionally V-shaped in an analogous way.

7. Device according to claim 6, characterized in that the pressure plate (5) is arranged to cooperate with a key plate (19) which is pivotally connected with and axially displaced along an axis (20) arranged on the stand (6), and connected with a ridge (21) centrally arranged on the top side of the pressure plate (5), via a carrier (22) carrying the pressure plate along when the key plate (19) is moved.

8. Device according to claim 1, characterized in that a position scale (16) is connected with the stand, which scale gives a number of common chords and with which scale cooperates a number of recesses (17) corresponding to the chords, and in that a stop element (18) is connected with the pressure plate (5), said element being brought into engagement with a selected recess (17) in order to withhold the plate in an axial adjusted position that corresponds to a desired chord.

9. Device according to claim 8, characterized in that the pressure plate (5) is arranged to cooperate with a key plate (19) which is pivotally connected with and axially displaced along an axis (20) arranged on the stand (6), and connected with a ridge (21) centrally arranged on the top side of the pressure plate (5), via a carrier (22) carrying the pressure plate along when the key plate (19) is moved.

10. Device according to claim 8, characterized in that the individual recess (17) is cross-sectionally V-shaped and that the stop element (18) is cross-sectionally V-shaped in an analogous way.

11. Device according to claim 10, characterized in that the pressure plate (5) is arranged to cooperate with a key plate (19) which is pivotally connected with and axially displaced along an axis (20) arranged on the stand (6), and connected with a ridge (21) centrally arranged on the top side of the pressure plate (5), via a carrier (22) carrying the pressure plate along when the key plate (19) is moved.

12. Device according to claim 1, characterized in that the pressure plate (5) is arranged to cooperate with a key plate (19) which is pivotally connected with and axially displaced along an axis (20) arranged on the stand (6), and connected with a ridge (21) centrally arranged on the top side of the pressure plate (5), via a carrier (22) carrying the pressure plate along when the key plate (19) is moved.

13. Device according to claim 12, characterized in that pressing down the pressure plate (5) by means of two lever means (23, 23'), each one of which comprising an arm (24) and a cross-plate (25) which with opposed ends engages between the pressure plate and longitudinal edge flanges (28) on the stand, the cross-plates (25) pressing down the pressure plate (5) at four separate points when the arms (24) are turned down from an initial position.

14. Device according to 13, characterized in that the transmission means are in the shape of taps (15) which are arranged in recesses (14) in cross-pieces (8) extending between the lateral pieces (7, 7') of the stand, the individual tap (15) pressing downwards against the appurtenant string (2) against the force of a spring, when being activated by an abutment element (12) on the pressure plate.

15. Device according to claim 1, characterized in that pressing down the pressure plate (5) by means of two lever means (23, 23'), each one of which comprising an arm (24) and a cross-plate (25) which with opposed ends engages between the pressure plate and longitudinal edge flanges (28) on the stand, the cross-plates (25) pressing down the pressure plate (5) at four separate points when the arms (24) are turned down from an initial position.

16. Device according to claim 15, characterized in that the pressure plate (5) comprises a plurality of pins (12) serving as abutment elements, each one of which being adjustably movable between an inactive position when introduced into a hole (13) in which the pin is not activating any transmission means, and an active position when protruding downwards from the hole, in which active position a cooperating transmission means is activated.

17. Device according to 16, characterized in that the transmission means are in the shape of taps (15) which are arranged in recesses (14) in cross-pieces (8) extending between the lateral pieces (7, 7') of the stand, the individual tap (15) pressing downwards against the appurtenant string (2) against the force of a spring, when being activated by an abutment element (12) on the pressure plate.

18. Device according to claim 1, characterized in that the pressure plate (5) comprises a plurality of pins (12) serving as abutment elements, each one of which being adjustably movable between an inactive position when introduced into a hole (13) in which the pin is not activating any transmission means, and an active position when protruding downwards from the hole, in which active position a cooperating transmission means is activated.

19. Device according to claim 18, characterized in that the abutment elements are fixedly fastened on the underside of the pressure plate and in that the pressure plate is detachably mounted in the stand to be replaced by a pressure plate with another combination of abutment elements.

20. Device according to claim 1, characterized in that the abutment elements are fixedly fastened on the underside of the pressure plate and in that the pressure plate is detachably mounted in the stand to be replaced by a pressure plate with another combination of abutment elements.

* * * * *